United States Patent [19]

Shuert

[11] Patent Number: 5,042,396

[45] Date of Patent: Aug. 27, 1991

[54] PLASTIC PALLET

[76] Inventor: Lyle H. Shuert, 1034 Stratford Pl., Bloomfield Hills, Mich. 48013

[21] Appl. No.: 443,075

[22] Filed: Nov. 27, 1989

Related U.S. Application Data

[63] Continuation of Ser. No. 226,371, Jul. 29, 1988, abandoned.

[51] Int. Cl.[5] ..... B65D 19/26

[52] U.S. Cl. ..... 108/51.1; 248/618; 108/901

[58] Field of Search ..... 108/51.1, 901; 52/620, 52/792, 793, 814; 248/346, 618

[56] References Cited

U.S. PATENT DOCUMENTS

| | | | |
|---|---|---|---|
| 241,728 | 5/1881 | Saunders | 248/618 |
| 505,518 | 9/1893 | Gascoigne | 52/793 |
| 3,880,092 | 4/1975 | Seeber et al. | 108/51.1 |
| 4,159,681 | 7/1979 | Vandament | 108/51.1 |
| 4,606,278 | 8/1986 | Shuert | 108/901 X |
| 4,667,921 | 5/1987 | De Goncourt | 248/618 |
| 4,747,245 | 5/1988 | Lesmeister et al. | 52/793 X |

FOREIGN PATENT DOCUMENTS

| | | | |
|---|---|---|---|
| 804352 | 7/1949 | Fed. Rep. of Germany | 248/618 |
| 1403502 | 5/1965 | France | 108/51.1 |
| 92301 | 5/1938 | Sweden | 248/618 |
| 171374 | 5/1960 | Sweden | 108/51.1 |

*Primary Examiner*—Peter A. Aschenbrenner
*Attorney, Agent, or Firm*—Krass & Young

[57] ABSTRACT

A plastic pallet in which an insert assembly is positioned within the hollow of the plastic pallet to discourage warpage and failure especially in racked, storage situations. The insert assembly comprises a pair of beams arranged in an X-configuration, tower members secured at their upper ends to respective ends of the beams and positioned respectively in the four corners of the pallet, and tensioning straps extending between the tower members around the perimeter of the pallet proximate the upper surface of the bottom wall of the pallet. The X-configured beams are positioned in the space between the spaced upper and lower sheets of the platform structure of the pallet and are maintained in a convexly bowed configuration by the tensioning straps so as to resist downward bowing of the platform structure, even when the pallet is racked for extended periods of time in a loaded condition.

30 Claims, 4 Drawing Sheets

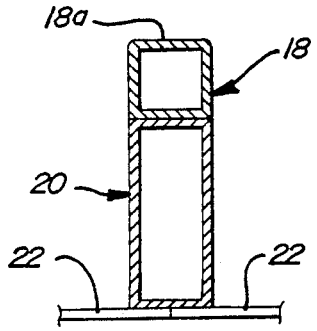
FIG - 3
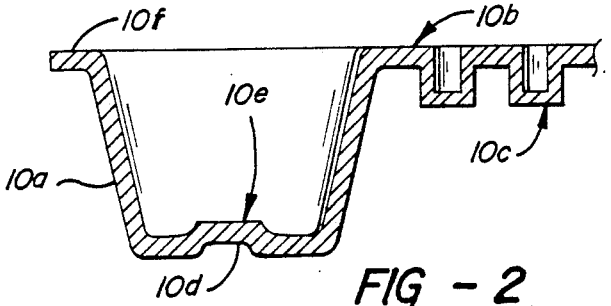
FIG - 2
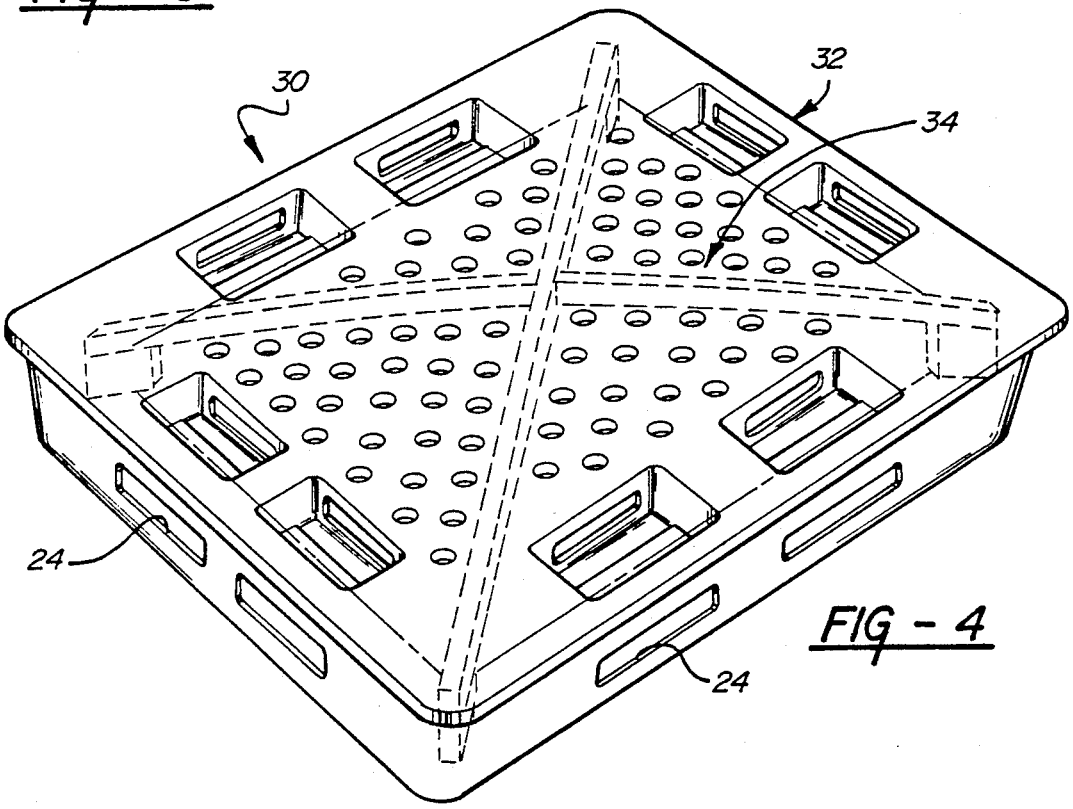
FIG - 4
FIG - 6
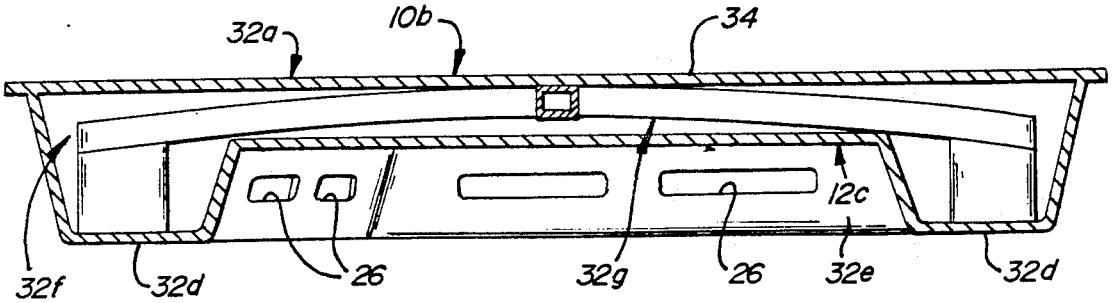

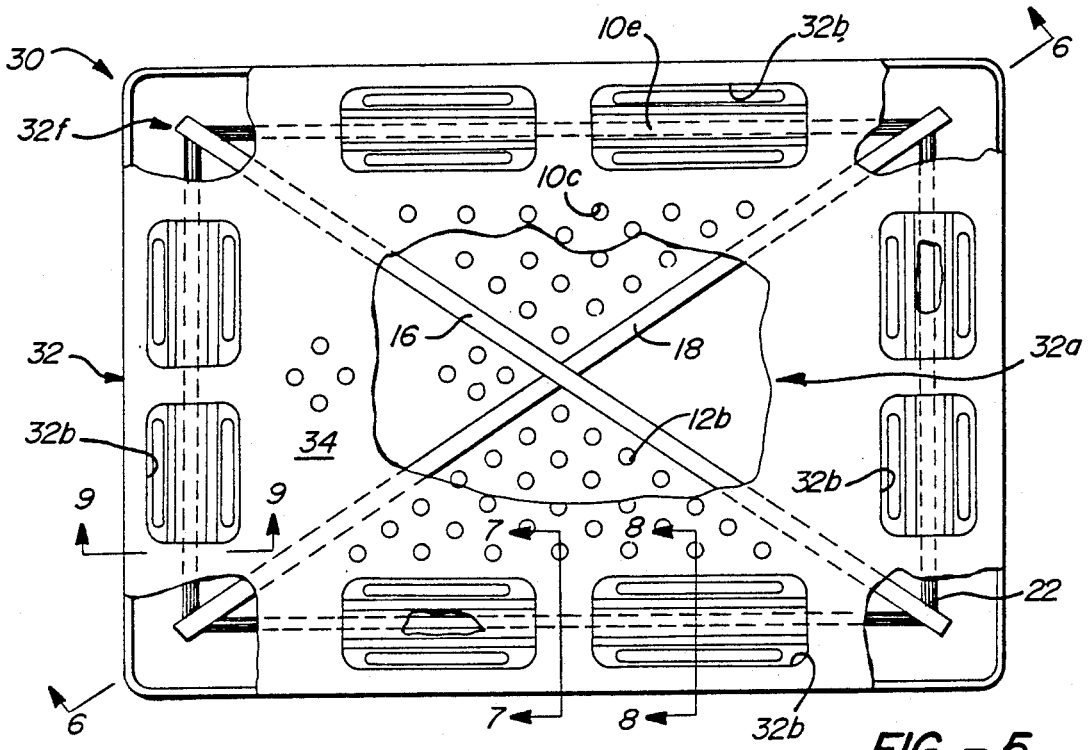
FIG - 5
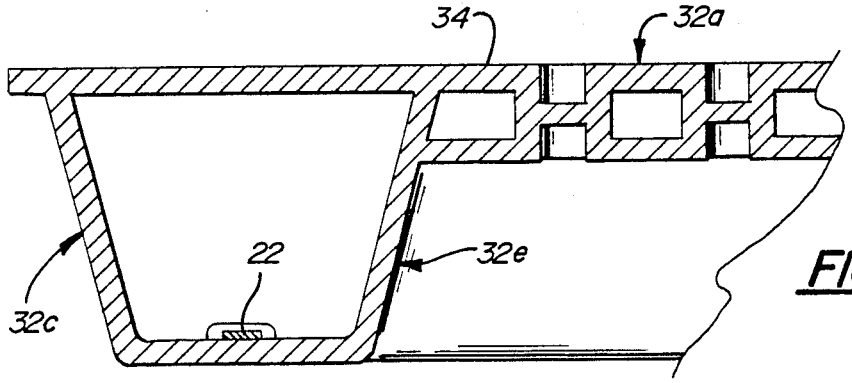
FIG - 7
FIG - 8
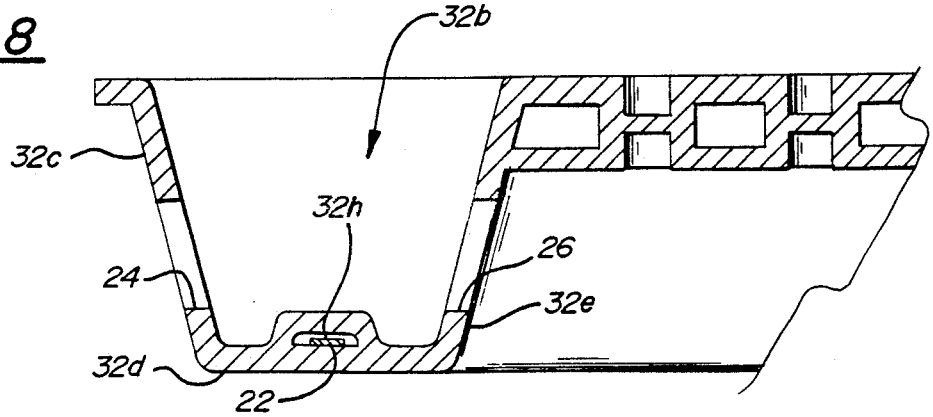

PLASTIC PALLET

This is a continuation of co-pending application Ser. No. 226,371 filed on July 29, 1988 now abandoned.

BACKGROUND OF THE INVENTION

This invention relates to shipping and storage pallets and more particularly to pallets having a plastic construction.

Pallets have traditionally been formed of wood. Wood pallets however have many disadvantages. For example, they are subject to breakage and thus are not reusable over an extended period of time. They also take up a considerable amount of valuable floor space in the warehouse when they are not in use. They are also difficult to maintain in a sanitary condition, thus limiting their usability in applications where sanitation is important, such, for example, as food handling applications. In an effort to solve some of the problems associated with wood pallets, plastic pallets have been employed with some degree of success. In one generally successful form of plastic pallet design, a twin sheet construction has been used in which upper and lower plastic sheets are formed in separate molding operations and the two sheets are then selectively fused or knitted together in a suitable press to form a reinforced double wall structure. Whereas these twin sheet plastic pallets are generally satisfactory, when they are stored in a rack in a loaded condition, the plastic material of the pallet, over a period of time, may tend to creep with the result that the platform structure of the pallet may warp to an extent that the pallet becomes disengaged from the rack support members and the pallet, with its load, falls out of the rack. The pallet warpage also creates problems with respect to automatic retrieval systems which depend for their successful operation on the pallet maintaining an essentially unwarped configuration. Attempts have been made to avoid these warpage problems in plastic pallets by arranging some manner of stiffening insert assembly in association with the plastic main body of the pallet but these prior art stiffening arrangements have tended to be unduly complicated and unduly expensive.

SUMMARY OF THE INVENTION

This invention is directed to the provision of a plastic pallet which is extremely resistant to creepage or warpage.

More specifically, this invention is directed to the provision of a plastic pallet which may be stored on a rack in a loaded condition over extended periods of time without incurring any significant creep or warpage.

The invention pallet, broadly considered, comprises a plastic member defining a generally planar load bearing platform structure defining a platform surface for receipt of a load and an insert positioned beneath the platform surface and having a convexly bowed configuration tending to flatten in response to placement of a load on the platform surface. This convexly bowed insert configuration provides a simple and inexpensive means of providing the required resistance to creepage or warping of the platform structure even when the pallet is stored in a loaded condition on a rack structure.

According to a further feature of the invention, the insert is in the form of a covexly bowed beam structure and the pallet further includes tensioning means connected to the beam structure and operative to maintain the beam structure in its bowed configuration and further operative to be further tensioned in response to flattening of the beam structure in response to placement of a load on the platform structure. The tensioning means and the bowed beam structure thus act in the manner of a stringed bow to maintain the beam structure in its convexly bowed configuration and resist any significant flattening of the beam structure in response to the load applied to the platform structure of the pallet.

According to a further feature of the invention, the plastic member is rectangular and the beam structure comprises first and second beams arranged in an X-configuration with an end of a beam positioned in each corner of the plastic member. This specific X-configuration provides a simple and inexpensive means of uniformly resisting downward bowing of the platform structure in response to an applied load.

According to a further feature of the invention, the tensioning means extends around the perimeter of the plastic member and interconnects the ends of the beams. This specific arrangement of the X-crossed beams and perimeter tensioning means provides a convenient and inexpensive means of uniformly loading the beams and uniformly resisting flattening of the beams.

According to a further feature of the invention, the plastic member defines hollow portions and the beams and tensioning means are positioned within the hollow portions of the plastic member. This arrangement enables the insert to be totally contained within the plastic member.

According to a further feature of the invention, the plastic member is formed as a twin sheet structure with the load bearing platform structure being defined by spaced upper and lower sheets and the beam structure is positioned in the space between the upper and lower sheets of the platform structure and extends from one side of the plastic member to an opposite side of the plastic member. This arrangement provides a convenient means of housing the beam structure within the plastic member without detracting from the structural integrity of the platform structure of the plastic member.

According to a further feature of the invention, the plastic member defines a hollow chamber at each corner of the plastic member communicating with the space between the spaced upper and lower sheets and extending downwardly from that space to the bottom of the plastic member, and the beam structure includes a tower member positioned in each chamber and connected at its upper end to a respective end of one of the beams and at its lower end to the tensioning means. This arrangement further facilitates the packaging of the insert assembly within the plastic member.

According to a further feature of the invention, the plastic member defines an outer side wall along each side thereof and a pair of openings are provided in each side wall for passage of the forks of a fork-lift truck, and the tensioning means pass beneath the fork-lift openings. This arrangement provides a convenient and efficient means of providing fork-liftability for the pallet while not interfering with the functioning of the insert assembly.

According to a further feature of the invention, the plastic member further defines an annular bottom wall extending totally around the perimeter thereof to define a continuous circumferential footprint for the plastic member, and the tensioning means are positioned proximate the upper side of the bottom wall. This specific arrangement provides a convenient means of routing and positioning the tensioning means within the plastic pallet.

According to a further feature of the invention, the bottom wall is formed with elongated passage means along each side of the plastic member with each passage means opening at its opposite ends in the corner chambers of the plastic member, and the tensioning means comprises tensioning members extending through the elongated passage means and connected at their ends to respective tower members positioned in the respective corner chambers.

According to a further feature of the invention, the plastic member defines a plurality of circumferentially spaced pockets opening in the upper sheet of the platform structure with at least two pockets along each side of the plastic member and with each pocket defined in cross section by a respective outer side wall, the bottom wall of the plastic member, and by an inner side wall spaced inwardly from the respective outer side wall, and each fork-lift opening comprises a pair of aligned slots in an outer side wall and in a corresponding inner side wall. This arrangement provides an inexpensive means of providing reinforced fork-lift openings in which lower pallet portions are provided beneath the inserted forks to preclude tipping of the pallet even in the presence of an unbalanced load on the platform structure.

According to a further feature of the invention, each tensioning member comprises a strap secured at its opposite ends to the lower ends of a respective pair of tower members and passing through the bottom wall passages defined at the bottoms of the pockets along the respective side of the plastic member. This arrangement provides a convenient and efficient means of routing the tensioning members between the tower members while retaining the tensioning members totally within the interior of the plastic member.

In the disclosed embodiment of the invention, the plastic member is formed as a twin sheet member and includes a lower plastic sheet defining an upwardly opening, continuous, U-shaped, substantially constant depth groove extending in a closed loop around the total periphery of the lower sheet to define a continuous circumferential footprint on the undersurface of the lower sheet, and an upper plastic sheet defining a plurality of circumferentially spaced upwardly opening U-shaped protrusions extending downwardly from the general plane of the sheet and sized to nest within the groove of the lower sheet. In the fabrication of the plastic member, the upper sheet is positioned over the lower sheet with the protrusions positioned at circumferentially spaced locations in the groove of the lower sheets and the sheets are fused together to form double thickness U-shaped wall structures at the interfaces of the protrusions and the groove and a continuous circumferential footprint beneath the pallet, and aligned horizontally extending slots are provided in the opposite sides of the U-shaped wall structures to allow passage of the forks of a fork-lift truck. This arrangement provides a convenient and inexpensive means of forming the plastic member while providing reinforced openings for the fork-lift tines and providing a pallet portion beneath the openings to preclude tipping of the pallet while being lifted.

BRIEF DESCRIPTION OF THE DRAWINGS

FIGS. 2 and 3 are cross-sectional views taken on lines 2—2 and 3—3 of FIG. 1;

FIG. 4 is a perspective view of the invention pallet;

FIG. 5 is a partially fragmentary plan view of the invention pallet;

FIGS. 6, 7, 8 and 9 are cross-sectional views taken respectively on lines 6—6, 7—7, 8—8, and 9—9 of FIG. 5;

DETAILED DESCRIPTION OF THE PREFERRED EMBODIMENT

Figure 1:
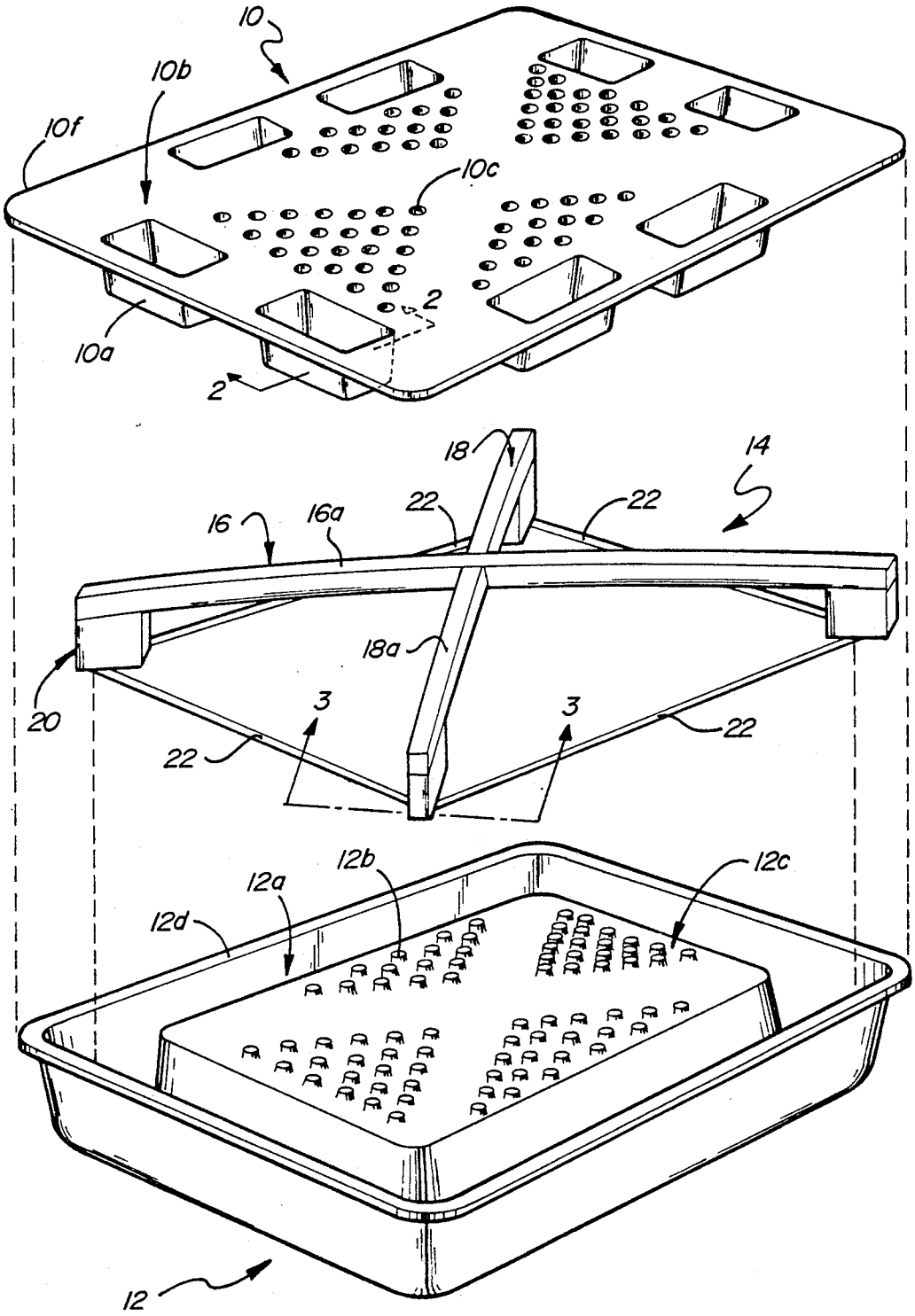
FIG. 1 is an exploded perspective view of the invention pallet.
Figure 10:
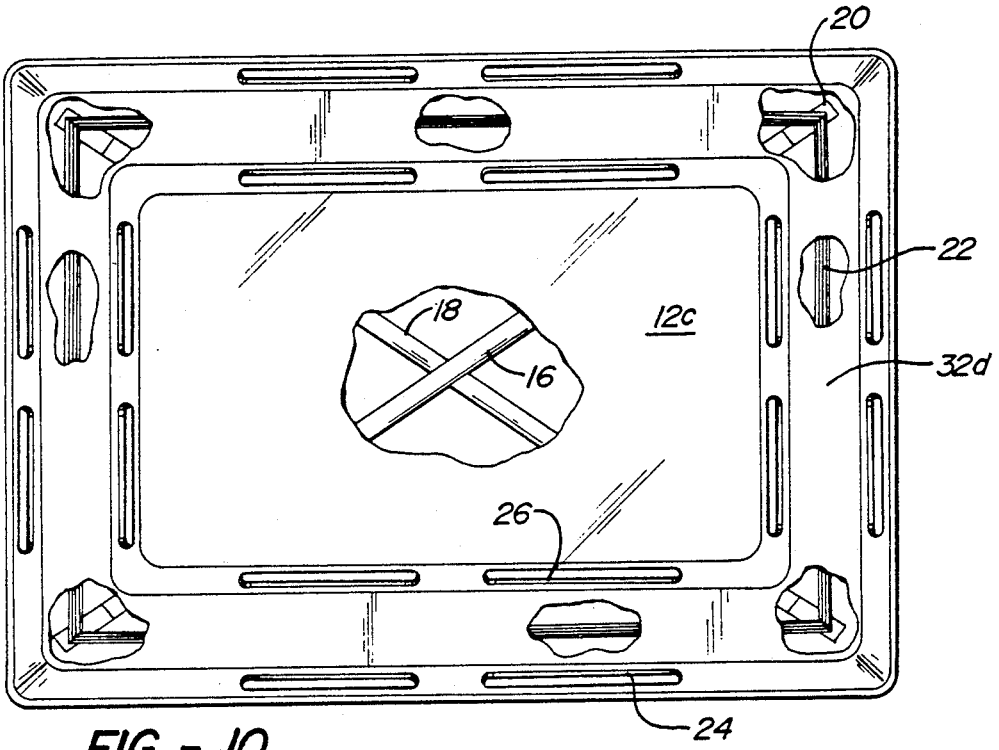
FIG. 10 is a partially fragmentary bottom view of the invention pallet.
Figure 9:
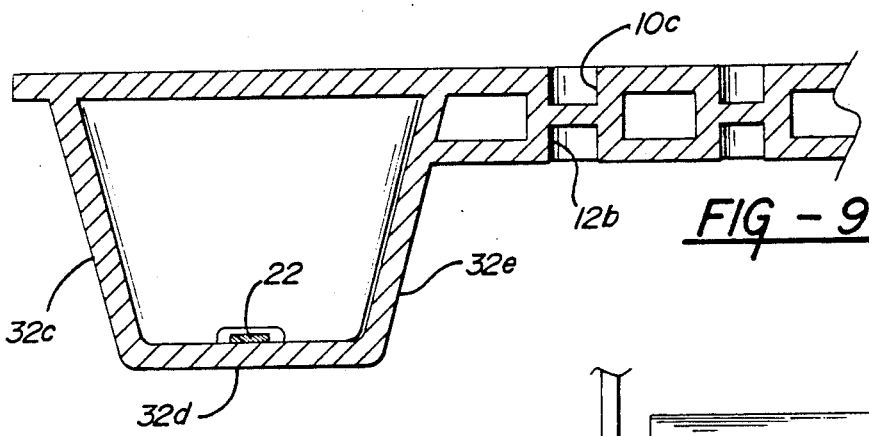

The invention pallet includes an upper plastic sheet 10, a lower plastic sheet 12, and an insert assembly 14.

Sheets 10 and 12 are molded in a vacuum forming process and may be formed of an organic polymeric material such as polyethylene.

Lower sheet 12 is suitably vacuum molded to provide an upwardly opening generally U-shaped peripheral groove 16 extending around its entire periphery and to provide a plurality of spaced upwardly extending protrusions or bosses **12*b* in the central main body portion 12*c*** of the sheet.

Upper sheet 10 is suitably vacuum molded to provide a plurality of circumferentially spaced upwardly opening U-shaped protrusions **10*a* extending downwardly from the main body portion 10*b* of the sheet and a plurality of downwardly extending protrusions or bosses 10*c* extending downwardly from the undersurface of main body portion 10*b*. A downwardly opening groove 10*d* is also provided by a raised central rib 10*e* in the bottom wall portion 10*e* of each protrusion 10*a***.

Insert assembly 14 comprises a pair of steel beams 16 and 18, a plurality of tower members 20, and a plurality of strap members 22. Beams 16, 18 are preferably formed of steel with a box or tubular cross section and are matingly notched in known manner at their midsections to allow the beams to be arranged in an X-configuration with the upper surfaces **16*a*, 18*a* of the beams generally flush with each other. Tower members 20 are formed of steel and have a box or tubular construction. A tower member 20 is secured as by welding at its upper end to an end of each beam member 16, 18. Straps 22 are preferably formed of steel and are secured by fasteners, clips or the like to the underface of tower members 20. Straps 22 interconnect the ends of the beams 16, 18 and extend around the perimeter of the insert assembly in a closed loop fashion. Straps 22 are suitably secured to the tower members 20 after the beams 16, 18 have been convexly bowed and serve to maintain the beams 16, 18** in their convexly bowed, prestressed configuration.

To form the invention pallet, following the vacuum formation of sheets 10 and 12 and the fabrication of insert assembly 14, insert assembly 14 is placed in nesting relation in lower sheet 12 with straps 22 positioned along the bottom of the four sides of groove **12*a*, tower members 20 positioned in groove 12*a* at the four corners of sheet 12, and beams 16 and 18 extending in crisscross fashion across the top of main body sheet portion 12*c* in the X-shaped space defined between the upwardly extending bosses or protrusions 12***b*. Sheets 10 and 12 are now brought together in a suitable press with the sheets still in a heated, formable condition to position the protrusions 10*a* within groove 12*a* and position the peripheral edge portion 10*f* of the upper sheet adjacent the peripheral edge portion 12*d* of the lower sheet. The upper and lower sheets fuse or knit together at the interface of edge portion 10*c* and edge portion 12*d*, further fuse or knit together at the interface of the protrusions 10*a* with the groove 12*a*, and further fuse or knit together at the interface of the downwardly extending bosses 10*c* and the upwardly extending bosses 12*b* to form the invention pallet. As the protrusions 10*a* nest within groove 12*a* and fuse to the adjacent material of the lower sheet 12, a double side wall thickness is formed adjacent the inner and outer side walls of groove 12*a*, and a double bottom wall thickness is formed with the respective strap 22 positioned in the passage formed by the groove 10*d* in the bottom wall of each protrusion 10*a*. Following the fusing together of the upper and lower sheets with the insert positioned therebetween, horizontally extending, aligned slots 24 and 26 are respectively formed in the double thickness outer side walls formed by the fusion of protrusions 10*a* with the adjacent material of lower sheet 12. Aligned slots 24, 26 provide slots for the entry of the forks of a fork-lift truck or other retrieval equipment.

The completed pallet 30 is seen in FIGS. 4–10. In the completed pallet, sheets 10 and 12 coact to define a plastic member 32 which is hollow and which totally encapsulate insert assembly 14. Specifically, in the completed pallet, the spaced central portions of sheets 10 and 12 coact to define a generally planar load bearing platform structure 32*a* including a load receiving upper platform surface 34 and further define a void 32*g* beneath the upper platform surface; the fused together upper bosses 10*c* and lower bosses 12*b* coact to reinforce platform structure 32*a*; protrusions 10*a* and groove 12*a* coact to define a plurality of circumferentially spaced pockets 32*b* opening in upper sheet 10 with two pockets along each side of the pallet and with each pocket defined in cross section by a double thickness portion of pallet outer side wall 32*c*, a double thickness portion of pallet bottom wall 32*d*, and a double thickness portion of pallet inner side wall 32*e*; a tower chamber 32*f* is defined at each corner of the plastic member communicating at its upper end with the space 32*g* defined between the upper and lower sheets of the platform structure and extending downwardly therefrom to the lower annular wall 32*d* of the plastic member; tower members 20 are respectively positioned in the four tower chambers 32*f* with their lower ends proximate bottom wall 32*d*; beam members 16 and 18 extend in a convexly bowed configuration through the space or void 32*g* defined between the upper and lower sheets of the platform structure in the X space provided between the fused together boss members; straps 22 extend around the perimeter of the plastic member proximate the upper face of bottom wall 32*d* and pass at the lower end of each pocket 32*b* through an elongated passage 32*h* defined at the fused interface of the bottom wall of lower sheet 12 and the bottom wall of protrusions 10*a*; the outer side wall 32*c* has a double thickness in the regions of the pockets 32*b* and a single thickness in the other regions of the side wall; the inner side wall 32*e* similarly has a double thickness in the regions of the pockets 32*b* and a single thickness in the other regions of the inner side wall; the bottom wall 32*d* similarly has a double thickness in the regions of the pockets 32*b* and has a single thickness in the other regions of the bottom wall; and aligned slots 24, 26 provide fork-lift entry slots with the solid pallet portion beneath the slots 24, 26 serving to trap the lift forks to preclude tipping of the pallet during a transfer operation.

In the completed pallet, straps 22 maintain beams 16,18 in a convexly bowed prestressed configuration with the central apex of the convexly bowed beam configuration positioned immediately beneath the central main body portion 10*b* of upper sheet 10 of the platform structure 32*a* so that any tendency of platform structure 32*a* to bow or warp concavely in response to placement of a load on platform surface 34 is resisted by the convexly bowed beam structure of the insert assembly. The beam structure is designed to yield downwardly or flatten slightly in response to loading of the platform structure but this flattening of the beam structure is accompanied by increased tensioning of the strap members 22 so as to minimize the amount of flattening of the beam structure that will occur even in response to very heavy loading of the platform structure.

Figure 11:
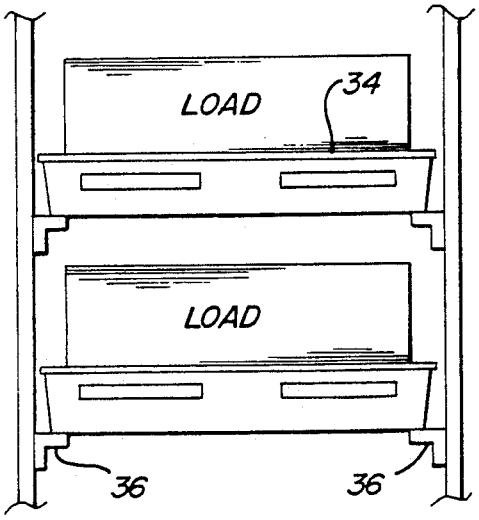
FIG. 11 is a fragmentary view of invention pallets in a racked, loaded disposition.

The invention insert assembly is especially effective in situations, as seen in FIG. 11, where the pallet 30 is loaded and then placed in a loaded condition on a storage rack with the pallet supported only along its peripheral undersides by bracket members 36. When thus racked, the tower members 20 are preferably positioned directly over the support flanges of the bracket members so that the load imposed on the platform structure of the pallet is transferred directly downwardly through towers 22 to bracket members 36.

Prior art plastic pallets, when utilized in the loaded and racked situation shown in FIG. 11, have had a tendency to creep or warp over a period of time with the result that the pallets have become disengaged from brackets 36 and the pallets, with their loads, have fallen out of the rack and/or the pallets have warped to an extent that they are no longer retrievable by automatic retrieval equipment which depends on the slots 24,26 remaining in a known, predetermined location. The invention insert assembly prevents such creepage or warpage and allows the otherwise desirable plastic pallets to be utilized even in applications requiring racked storage over long periods of time under loaded conditions. For example, in the food industry, the plastic pallets are definitely preferred to wooden pallets because of the improved sanitation aspects of the plastic pallet and yet the prior art plastic pallets have tended to warp and fall when loaded with food and stored in a racked configuration. The invention pallet thus retains all of the advantages of a plastic pallet while eliminating the tendency of the pallet to warp and fall under loaded, racked conditions. The invention pallet also provides excellent fork-liftability for the pallets and, specifically, provides lower members which pass beneath the inserted forks of the fork-lift truck to preclude tipping of the pallet even in the presence of an unbalanced load on the pallet. The invention pallet also provides a continuous lower footprint to facilitate movement of the pallet even over irregular transfer surfaces.

Whereas a preferred embodiment of the invention has been illustrated and described in detail, it will be apparent that various changes may be made in the disclosed embodiment without departing from the scope or spirit of the invention.

I claim:

1. A pallet comprising:

A) a generally planar load bearing platform structure formed as a unitary, molded plastic structure including an upper wall structure defining a platform surface at its upper side for receipt of a load and a bottom wall structure integral with said top structure and defining the bottom of said platform structure and spaced beneath said upper wall structure to define a void between said top and bottom wall structures; and B) an insert positioned beneath said upper wall structure in said void and having a convexly bowed configuration with its downwardly disposed opposite ends supported on said bottom wall structure but free to move relative to said bottom wall structure and its raised central portion disposed proximate the underside of said upper wall structure so as to tend to flatten in response to placement of a load on said platform surface.

2. A pallet according to claim 1 wherein:

C) said insert is in the form of a convexly bowed beam structure; and

D) said pallet further includes tensioning means connected to said beam structure operative to maintain said beam structure in said bowed configuration and operative to be further tensioned in response to flattening of said beam structure in response to placement of a load on said platform surface.

3. A pallet comprising:

A) a plastic member defining a generally planar load bearing platform structure defining a platform surface for receipt of a load; and B) an insert positioned beneath said platform surface and having a convexly bowed configuration tending to flatten in response to placement of a load on said platform surface;

C) said insert being in the form of a convexly bowed beam structure;

D) said pallet further including tensioning means connected to said beam structure operative to maintain said beam structure in said bowed configuration and operative to be further tensioned in response to flattening of said beam structure in response to placement of a load on said platform surface;

E) said plastic member being rectangular and defining a plurality of corners; and F) said beam structure comprising first and second beams arranged in an X-configuration with an end of a beam positioned in each corner of said plastic member.

4. A pallet according to claim 3 wherein:

G) said tensioning means extends around the perimeter of said plastic member and interconnects the ends of said beams.

5. A pallet according to claim 4 wherein:

H) said plastic member defines hollow portions; and

I) said beams and said tensioning means are positioned within said hollow portions of said plastic member.

6. A pallet according to claim 4 wherein:

H) said tensioning means comprises a plurality of straps each connected at its opposite ends to respective ends of said beams.

7. A pallet comprising:

A) a plastic member defining a generally planar load bearing platform structure defining a platform surface for receipt of a load; and B) an insert positioned beneath said platform surface and having a convexly bowed configuration tending to flatten in response to placement of a load said platform surface;

C) said load bearing platform structure including spaced upper and lower sheets;

D) said beam structure being positioned in the space between said upper and lower sheets and extending from one side of said plastic member to an opposite side of said plastic member;

E) said pallet including tensioning means maintaining said beam structure in its bowed configuration;

F) said platform structure being rectangular and defining a plurality of corners;

G) said beam structure comprising first and second beams arranged in an X configuration with an end of a beam positioned in each corner of said plastic member.

8. A pallet according to claim 7 wherein:

I) said tensioning means extends around the perimeter of said plastic member and interconnects the ends of said beams.

9. A pallet according to claim 8 wherein:

J) said plastic member defines a hollow chamber at each corner thereof communicating with the space between said upper and lower sheets and extending downwardly from said space to the bottom of said plastic member; and K) said beam structure includes a tower member positioned in each chamber and connected at its upper end to a respective end of one of said beams and at its lower end to said tensioning means.

10. A pallet according to claim 9 wherein:

L) said plastic member defines an outer side wall along each side thereof and a pair of openings are provided in each side wall for passage of the forks of a fork-lift truck; and M) said tensioning means pass beneath said fork-lift openings.

11. A pallet according to claim 10 wherein:

N) said plastic member further defines an annular bottom wall extending totally around the perimeter thereof to define a continuous circumferential footprint for the plastic member; and O) said tensioning means are positioned proximate the upper side of said bottom wall.

12. A pallet according to claim 11 wherein:

P) said bottom wall is formed with elongated passage means along each side of said plastic member with each passage means opening at its opposite ends in said corner chambers; and Q) said tensioning means comprise tensioning members extending through said elongated passage means and connected at their ends to respective tower members positioned in respective chambers.

13. A pallet according to claim 12 wherein:

R) said plastic member defines a plurality of circumferentially spaced pockets opening in said upper sheet of said platform structure with at least two pockets along each side of said plastic member and with each pocket defined in cross section by a respective outer side wall, said bottom wall, and an inner side wall spaced inwardly from the respective outer side wall; and S) each said fork-lift opening comprises a pair of aligned slots in an outer side wall and in a corresponding inner side wall.

14. A pallet according to claim 13 wherein:

T) said passage means comprises a passage in said bottom wall at the bottom of each pocket in the respective side of said plastic member.

15. A pallet according to claim 14 wherein:

U) each said tensioning member comprises a strap secured at its opposite ends to the lower ends of a respective pair of tower members and passing through the bottom wall passages defined at the bottoms of the pockets along the respective side of the plastic member.

16. A pallet comprising:

A) a generally rectangular, hollow plastic member defining a central load bearing platform structure formed by spaced upper and lower sheets and further defining a void between said sheets;

B) a beam structure positioned in said void in underlying relation to said upper sheet; and C) tensioning means maintaining said beam structure in a convexly bowed configuration within said void so that said beam structure tends to flatten in said void against the tensioning resistance of said tensioning means in response to placement of a load on said upper sheet of said platform structure.

17. A pallet comprising:

A) a generally rectangular, hollow plastic member defining a plurality of corners and further defining a central load bearing platform structure formed by spaced upper and lower sheets;

B) a beam structure positioned in the central space between said upper and lower sheets and including a pair of beams arranged in an X configuration with an end of a beam positioned in each corner of said plastic member; and C) tensioning means maintaining said beam structure in a convexly bowed configuration so that said beam structure tends to flatten against the tensioning resistance of said tensioning means in response to placement of a load on said platform structure.

18. A pallet according to claim 17 wherein:

D) said plastic member further defines a tower chamber at each corner of said member communicating with the central space between said upper and lower sheets and extending downwardly therefrom to the bottom of the plastic member;

E) said pallet further includes a tower member positioned in each tower chamber and connected at its upper end to an end of a respective beam; and F) said tensioning means extend between said tower members around the perimeter of said plastic member.

19. A pallet according to claim 18 wherein:

G) said plastic member further defines an annular bottom wall extending around the perimeter of said plastic member and defining the bottom wall of each tower chamber, an annular outer side wall extending upwardly from said bottom wall and defining the outer side wall of each tower chamber, and an annular inner side wall extending upwardly from said bottom wall in inwardly spaced relation to said outer side wall and defining the inner side wall of each tower chamber.

20. A pallet according to claim 19 wherein:

H) said tensioning means comprises tensioning members innterconnecting the lower ends of said tower members and extending around the perimeter of said plastic member proximate the upper side of said bottom wall.

21. A pallet according to claim 20 wherein:

I) said plastic member further includes a pair of fork-lift openings along each side of said plastic member; and J) each opening comprises a pair of aligned slots in said outer side wall and in said inner side wall.

22. A pallet according to claim 21 wherein:

K) said plastic member further includes a plurality of circumferentially spaced pockets opening in said upper sheet with at least two pockets along each side of said plastic member and with each pocket defined in transverse cross section by said outer side wall, said bottom wall, and said inner side wall.

23. A pallet according to claim 22 wherein:

L) the aligned slots defining said fork-lift openings are formed in the portions of said outer and inner side walls defining said pockets.

24. A pallet according to claim 23 wherein:

M) each tensioning member is connected to the lower end of a tower member and extends along the upper face of said bottom wall for connection to the lower end of another tower member.

25. A pallet according to claim 24 wherein:

N) a passage is formed in said bottom wall at the bottom of each pocket; and

O) said tensioning members are passed through said bottom wall passages.

26. A pallet according to claim 25 wherein:

P) said tensioning members comprise steel straps with each strap fixedly secured to the lower ends of a respective pair of tower members.

27. A pallet according to claim 25 wherein:

P) said plastic member is a twin sheet member formed by thermal forming upper and lower sheets and then selectively fusing said sheets together.

28. A pallet comprising:

A) a plastic member defining a generally planar load bearing platform structure including an upper platform surface for receipt of a load and further defining a void beneath said platform surface;

B) an insert positioned beneath said platform surface in said void and having a convexly bowed configuration tending to flatten in response to placement of a load on said platform surface;

C) said load bearing platform structure including spaced upper and lower sheets;

D) said void being defined between said upper and lower sheets and extending from one side of said platform member to an opposite side of said platform member; and E) said pallet including tensioning means connected to said insert, operative to normally maintain said insert in its bowed configuration, and operative in response to placement of a load on said platform surface to resist flattening of said insert.

29. A pallet comprising:

A) a unitary plastic member including a generally planar load bearing upper plastic structure defining an upper platform surface for receipt of a load and further including a lower plastic structure spaced below said upper plastic structure to define a lower support surface for the pallet and to define a void between said upper and lower plastic structures; and B) a convexly bowed beam structure positioned beneath said platform surface in said void and comprising first and second beams arranged in an X-configuration with the ends of the beams supported on said lower plastic structure and free to move relative to said plastic member.

30. A pallet according to claim 29 wherein:

C) said plastic member is rectangular and defines a plurality of corners; and

D) said first and second beams of said beam structure, are arranged with an end of a beam positioned in each corner of the plastic member.

* * * * *